US008935982B2

(12) United States Patent
Zhou et al.

(10) Patent No.: US 8,935,982 B2
(45) Date of Patent: Jan. 20, 2015

(54) TRANSFER PRINTING APPARATUS FOR MASK PATTERN AND MASK PATTERN PREPARATION METHOD

(75) Inventors: Weifeng Zhou, Beijing (CN); Jian Guo, Beijing (CN); Xing Ming, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 203 days.

(21) Appl. No.: 13/380,115

(22) PCT Filed: Mar. 24, 2011

(86) PCT No.: PCT/CN2011/072109
§ 371 (c)(1),
(2), (4) Date: Dec. 22, 2011

(87) PCT Pub. No.: WO2011/131073
PCT Pub. Date: Oct. 27, 2011

(65) Prior Publication Data

US 2012/0097056 A1 Apr. 26, 2012

(30) Foreign Application Priority Data

Apr. 21, 2010 (CN) ..... 2010 1 0156361

(51) Int. Cl.
*B41M 1/42* (2006.01)
*B41J 2/43* (2006.01)
(Continued)

(52) U.S. Cl.
CPC ..... *B41J 2/43* (2013.01); *G03G 15/221* (2013.01); *G03G 19/00* (2013.01)
USPC ..... 101/489; 427/132; 427/198; 427/217

(58) Field of Classification Search
CPC ..... G03G 15/221; G03G 19/00; B41J 2/43; B41M 7/0045; B41M 7/0072; B41F 13/08
USPC ..... 101/489, 250; 427/547, 550; 399/411
See application file for complete search history.

(56) References Cited

U.S. PATENT DOCUMENTS 4,138,685 A * 2/1979 Kellerman ..... 346/74.2
5,061,093 A * 10/1991 Yamaguchi et al. ..... 400/241.1
(Continued)

FOREIGN PATENT DOCUMENTS

CN 1143203 A 2/1997
CN 1144347 A 3/1997
(Continued)

OTHER PUBLICATIONS

Declaration of Non-Establishment of Internation Search Report mailed Jun. 9, 2011 PCT/CN2011/072109.
(Continued)

*Primary Examiner* — Daniel J Colilla
*Assistant Examiner* — Justin Olamit
(74) *Attorney, Agent, or Firm* — Ladas & Parry LLP

(57) ABSTRACT

The present invention discloses a mask pattern transferring device and a method of preparing a mask pattern transferring device. The mask pattern transferring device comprises: a magnetization head disposed on a magnetization head carrying device, for magnetizing composite powders each comprising a core of ferromagnetic metal and an outer resin film; a rotary roller formed of a non-ferromagnetic material, for adsorbing the composite powders magnetized by the magnetization head; a demagnetization head disposed at a downstream of the magnetization head in the rotating direction of the rotary roller, for demagnetizing the magnetized composite powders adsorbed by the rotary roller; and a collecting container, the outer edge of which is tangent with one side of the rotary roller, and which is disposed at the downstream of the magnetization head along the periphery of the rotary roller to collect the demagnetized composite powders.

17 Claims, 4 Drawing Sheets

(51) Int. Cl.
*G03G 15/22* (2006.01)
*G03G 19/00* (2006.01)

(56) References Cited

U.S. PATENT DOCUMENTS

| | | | |
|---|---|---|---|
| 5,659,852 | A | 8/1997 | Chigono et al. |
| 2007/0184195 | A1 | 8/2007 | Hatakeyama et al. |

FOREIGN PATENT DOCUMENTS

| | | | |
|---|---|---|---|
| CN | 101013274 | A | 8/2007 |
| CN | 101100742 | A | 1/2008 |
| JP | 57-154252 | A | 9/1982 |
| JP | 57-207334 | A | 12/1982 |
| JP | 60-058874 | A | 4/1985 |
| JP | 60-169881 | A | 9/1985 |
| JP | 01-195065 | A | 8/1989 |
| JP | 01-262144 | A | 10/1989 |
| JP | 02-293164 | A | 12/1990 |
| JP | 2007-035439 | A | 2/2007 |

OTHER PUBLICATIONS

International Preliminary Report on Patentability; issued Oct. 23, 2012; PCT/CN2011/072109.

First Chinese Office Action dated Nov. 2, 2012; Appln. 201010156361.7.

Second Chinese Office Action dated Jun. 26, 2013; Appln. No. 201010156361.7.

* cited by examiner

TRANSFER PRINTING APPARATUS FOR MASK PATTERN AND MASK PATTERN PREPARATION METHOD

TECHNICAL FIELD

Embodiments of the present invention relate to a mask pattern transferring device and a method of preparing a mask pattern.

BACKGROUND

Liquid crystal displays (LCDs) are the currently popular flat panel displays. With the fast development in the recent decade, great improvements have been achieved in terms of screen size and display quality of LCDs. With the increasing production scale of LCDs, the competition among the manufacturers is becoming drastic. The manufacturers are trying to reduce the production cost while improving the quality of the LCD product, thus improving their competing power in the market.

At present, a mask exposure process is one of the necessary processes in the preparation of LCDs. The mask exposure process includes steps of below: transferring the pattern on the mask plate by means of exposure to the photosensitive photoresist layer prepared by processes of coating, drying under a low pressure, pre-baking etc, and so on; forming the photoresist layer into a mask pattern by means of processes of developing and post-baking; transferring the mask pattern to a structure layer by means of processes of etching and removing, thus completing the preparation of one layer of structure pattern. A LCD may be prepared by repeating the above steps several times.

However, preparing a LCD through mask exposure processes requires using mask plates, and the preparing of the molds involving extremely expensive cost makes the production cost of LCDs high; further, the modification to the plate is difficult when an error is happened in the design of the mask plate. In addition, the process of preparing photoresist layer requires steps of drying under a low pressure, pre-baking, developing and so on, and consumable stuffs such as developing liquid, compressed air, etc., are needed in these steps, which makes the production cost of the LCD increase.

SUMMARY

The present invention provides a mask pattern transferring device and a method of preparing a mask pattern, for reducing production costs of LCDs.

The present invention provides a mask pattern transferring device comprising: a magnetization head disposed on a magnetization head carrying device, for magnetizing composite powders each comprising a core of ferromagnetic metal and an outer resin film; a rotary roller formed of a non-ferromagnetic material, for adsorbing the composite powders magnetized by the magnetization head; a demagnetization head disposed at a downstream of the magnetization head in the rotating direction of the rotary roller, for demagnetizing the magnetized composite powders adsorbed by the rotary roller; and a collecting container, the outer edge of which is tangent with one side of the rotary roller, and which is disposed at the downstream of the magnetization head along the periphery of the rotary roller to collect the demagnetized composite powders.

The present invention further provides a method of preparing mask pattern comprising: providing a substrate, wherein a structure layer film is formed on the substrate, a layer of composite powders is formed on a surface of the structure layer film, and the composite powders each include a core of ferromagnetic metal and a outer resin film; magnetizing the composite powder on a part of the structure layer film on the substrate corresponding to an area to be without protection of mask pattern; adsorbing the magnetized composite powders, so as to form a pre-mask pattern with the composite powders left on the substrate; processing the pre-mask pattern formed on the substrate, so that the outer resin film of the left composite powders is melted to eliminate clearance within the pre-mask pattern, thus forming the mask pattern.

DETAILED DESCRIPTION

In order to make the objectives, technical solutions and advantages of the embodiments of the present invention more apparent, the technical solutions of the embodiments of the present invention are made clear and complete below with reference to the accompanying drawings of the embodiments of the present invention. It is clear that the described embodiments are just a part of the embodiments, rather than all of the embodiments of the present invention. All of the other embodiments made by those skilled in the art without any inventive efforts under the teaching of the illustrated embodiments of the present invention fall within the scopes sought to be protected by the present invention.

Figure 1:
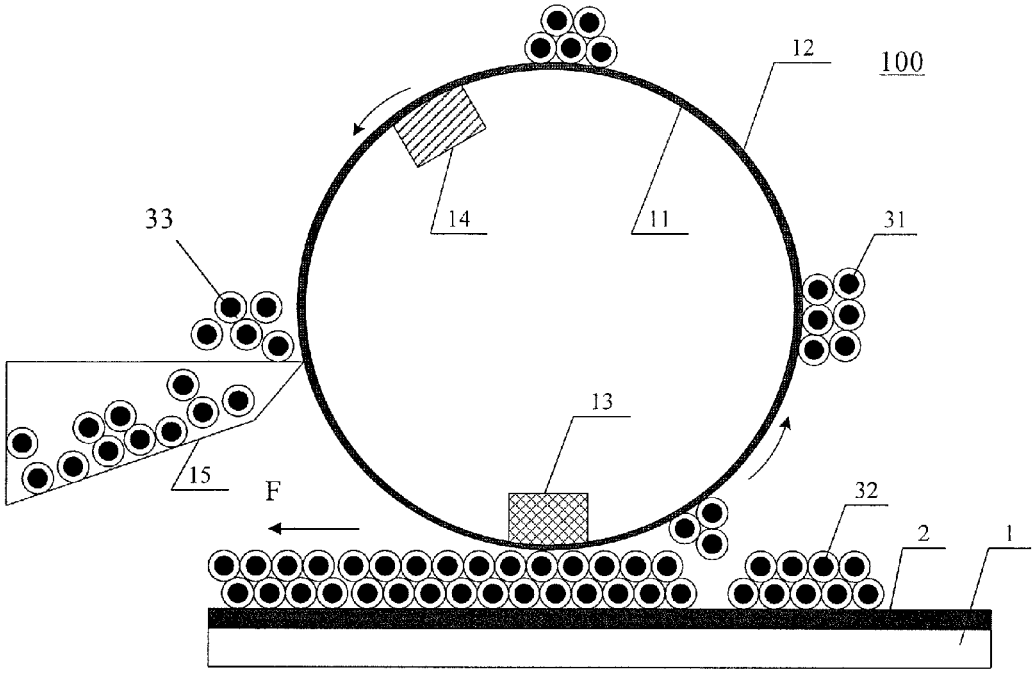
FIG. 1 is a schematic view of the mask pattern transferring device provided by a first embodiment of the present invention.
Figure 2:
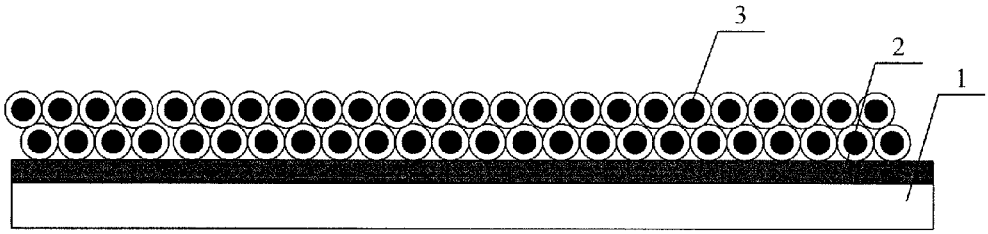
FIG. 2 is a schematic view of the pattern layer formed in the first embodiment of the present invention.
Figure 3:
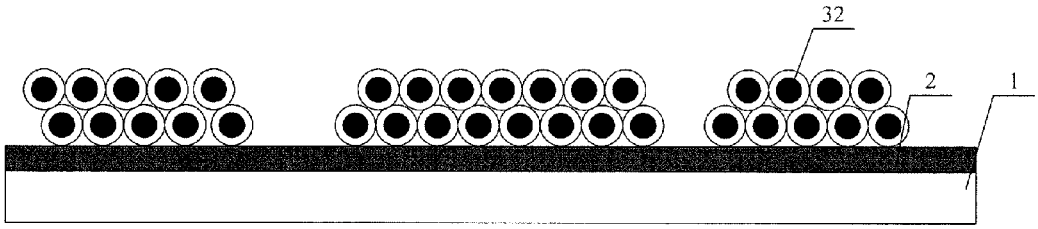
FIG. 3 is a schematic view of the pre-mask pattern formed in the first embodiment of the present invention.
Figure 4:
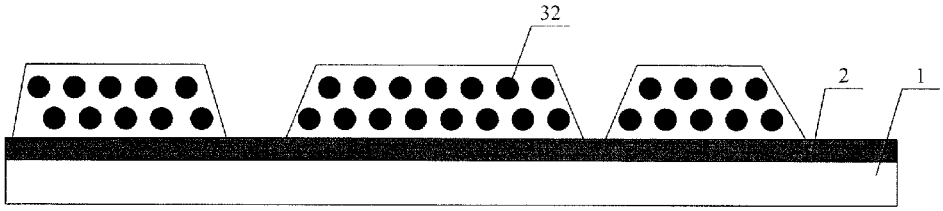
FIG. 4 is a schematic view of the mask pattern formed in the first embodiment of the present invention.

FIG. 1 is a schematic view of the mask pattern transferring device 100 provided by a first embodiment of the present invention. FIG. 2 is a schematic view of the pattern layer formed in the first embodiment of the present invention. FIG. 3 is a schematic view of the pre-mask pattern formed in the first embodiment of the present invention. FIG. 4 is a schematic view of the mask pattern formed in the first embodiment of the present invention.

As shown in the FIG. 1, the mask pattern transferring device 100 comprises: an inner roller 11, an outer roller 12, a magnetization head 13, a demagnetization head 14 and a collecting container 15.

The inner roller 11 is an example of a magnetization head carrying device, which is stationary relative to the axle (not shown) of the inner roller, that is, the inner roller 11 is a non-rotary inner roller. The outer roller 12 is an example of a rotary roller, which is formed of a non-ferromagnetic material. The inner roller 11 is nested within the outer roller 12, and the two rollers are co-axially arranged. The inner roller 11 and the outer roller 12 can move on the horizontal plane relative to the substrate 1 placed on the carrying table (not shown). The substrate 1 is an object to be processed on which the mask pattern is to be formed. Particularly, if the substrate 1 is stationary, the inner roller 11 and the outer roller 12 conduct horizontal movements on the horizontal plane relative to the substrate 1. If the inner roller 11 and the outer roller 12 are stationary in the horizontal direction, the substrate 1 conducts horizontal movement in the horizontal plane relative to the inner roller 11. Or, both the substrate 1 and the inner roller 11 and outer roller 12 conduct horizontal movements on the horizontal plane, as long as they have relative movements. As indicated by the arrow F in the FIG. 1, the inner roller 11 and the outer roller 12 move to the right side relative to the substrate 1.

The magnetization head 13 is disposed within the inner roller 11, at the bottom of the inner roller which has a shortest distance from the substrate 1, i.e., at the lowermost part of the inner roller 11, for magnetizing the composite powders 3 in the part on the substrate 1 formed with a structure layer film 2 and corresponding to the area to be without mask protection. As shown in FIG. 2, before the operation of patterning, the composite powders 3 are evenly distributed on the structure layer film 2. An example of the composite powders 3 include powders each having a core of a ferromagnetic metal and an outer shell of a resin film. There is several ways to evenly distribute composite powders 3 on the structure layer film 2, for example, evenly ejecting composite powders 3 on the structure layer film 2 by an ejecting gun; or evenly printing composite powders 3 coated with a certain solvent (for example, water) and forming the film of composite powders 3 after the coating solvent is volatilized; or spreading the composite powders 3 on the structure layer film 2 and scraping the composite powders 3 to be even by horizontally moving a device above the substrate 1 with a constant speed. In addition, in other embodiments, the magnetization head 13 may be disposed on the lower part of the inner roller 11, closer to the substrate 1 compared with other components, as long as the magnetization head 13 can magnetize the composite powders 3 on the structure layer film 2 on a part of the substrate 1 corresponding to the area to be without mask protection.

The outer roller 12 formed of a non-ferromagnetic material is used to rotate about the inner roller 11, adsorb the composite powders 3 magnetized by the magnetization head 13, thus the composite powders 32 left on the substrate 1 forming a pre-mask pattern, as shown in FIGS. 1 and 3. The formed pre-mask pattern is baked, and the outer resin film of the left composite powder 32 is melted to eliminate the clearance within the pre-mask pattern, and then a mask pattern is prepared, as shown in FIG. 4.

The demagnetization head 14 is disposed on the inner roller, at the downstream of the magnetization head in the rotation direction of the outer roller, used to performing the operation of demagnetizing the magnetized composite powders 31 adsorbed by the outer roller 12, as shown in FIG. 1. The part of the outer roller 12 rotating toward the substrate 1 is the left half of the outer roller 12. A collecting container 15 is disposed on the rear side of the outer roller 12. The outer edge of the collecting container 15 is tangent with the side of the outer roller 12 rotating toward the substrate 1, and is disposed below the demagnetization head 14, for collecting the demagnetized composite powders 33, as shown in the FIG. 1.

Figure 5:
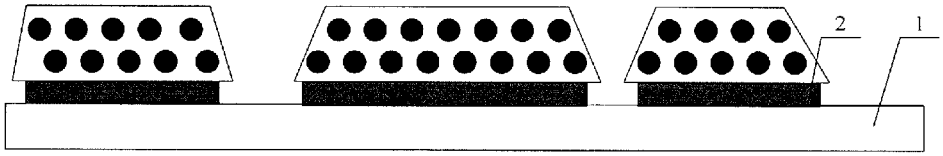
FIG. 5 is a schematic view of etching a structure layer with the mask pattern formed in the first embodiment of the present invention.

FIG. 5 is a schematic view of etching a structure layer with the mask pattern formed in the first embodiment of the present invention. After the mask pattern is formed on the substrate 1 with the mask pattern transferring device, the subsequent etching process is performed in a conventional way, then the mask pattern is removed, and thus the structure pattern of the structure layer film 2 on the substrate 1 is prepared. The etching process employed may be a dry-etching process or a wet-etching process.

The mask pattern transferring device 100 in the present embodiment performs process onto the composite powders 3 on the substrate 1 by means of technologies of magnetization and demagnetization, and thus the mask pattern is prepared, without a mask plate, a developing process and so on to preparing the mask pattern, thus improving the efficiency of producing LCDs and the quality of LCDs, and reducing the cost of producing LCD.

Figure 6:
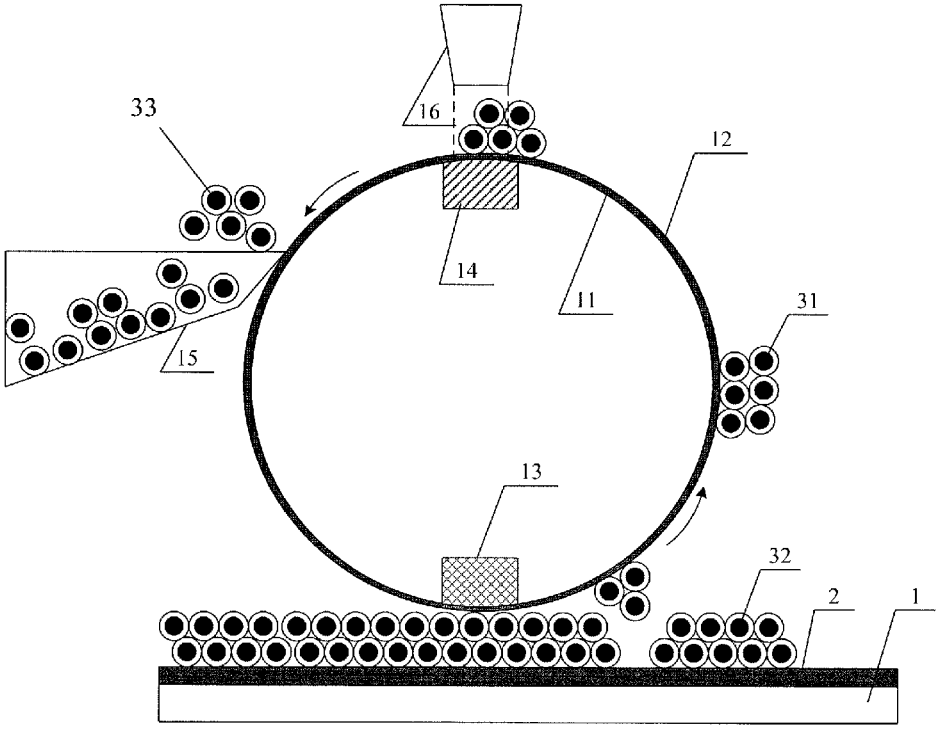
FIG. 6 is a schematic view of the mask pattern transferring device provided by a second embodiment of the present invention.

FIG. 6 is a schematic view of the mask pattern transferring device provided by a second embodiment of the present invention. As shown in FIG. 6, the difference from the mask pattern transferring device provided by the first embodiment lies in that, an adsorption collector 16 is disposed at the outside of the outer roller 12, and a collecting mouth of the adsorption collector 16 is in the radial direction passing through the demagnetization head 14, for collecting the composite powders 33 demagnetized by the demagnetization head 14. The adsorption collector 16 in the present embodiment can assist the collecting container 15 in collecting the demagnetized composite powders 33, thus ensuring the demagnetized composite powders 33 to be removed away from the outer roller 12.

Figure 7:
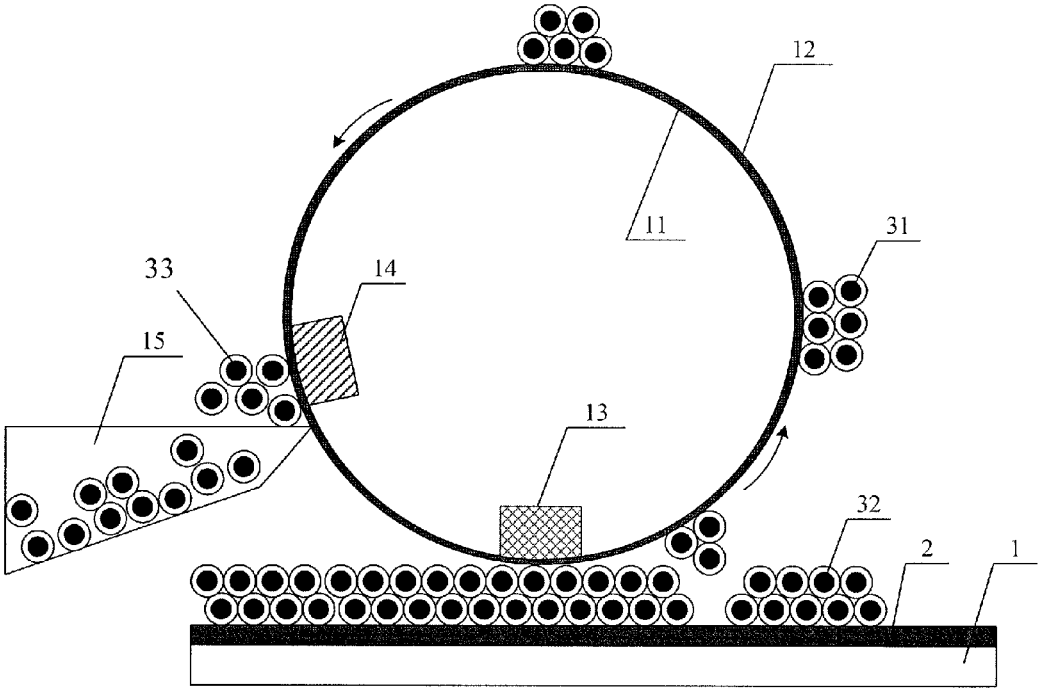
FIG. 7 is a schematic view of the mask pattern transferring device provided by a third embodiment of the present invention.

FIG. 7 is a schematic view of the mask pattern transferring device provided by a third embodiment of the present invention. As shown in FIG. 7, the difference from the mask pattern transferring devices provided by the first and second embodiments lies in that, the demagnetization head 14 is disposed on the edge of the inner roller 11 that is lower than the rotation axle center and corresponds to the part of the outer roller 12 rotating toward to the substrate 1, so as to shorten the distance between the demagnetization head 14 and the collecting container 15, and thus the collecting container 15 can collect the demagnetized composite powders 33 at the position lower than the rotation axle center of the inner roller 11. The friction between the outer edge of the collecting container 15 and the outer roller 12 makes the demagnetized composite powders 33 more easily separated from the outer roller 12. FIG. 7 illustrates the condition without the adsorption collector.

Figure 8:
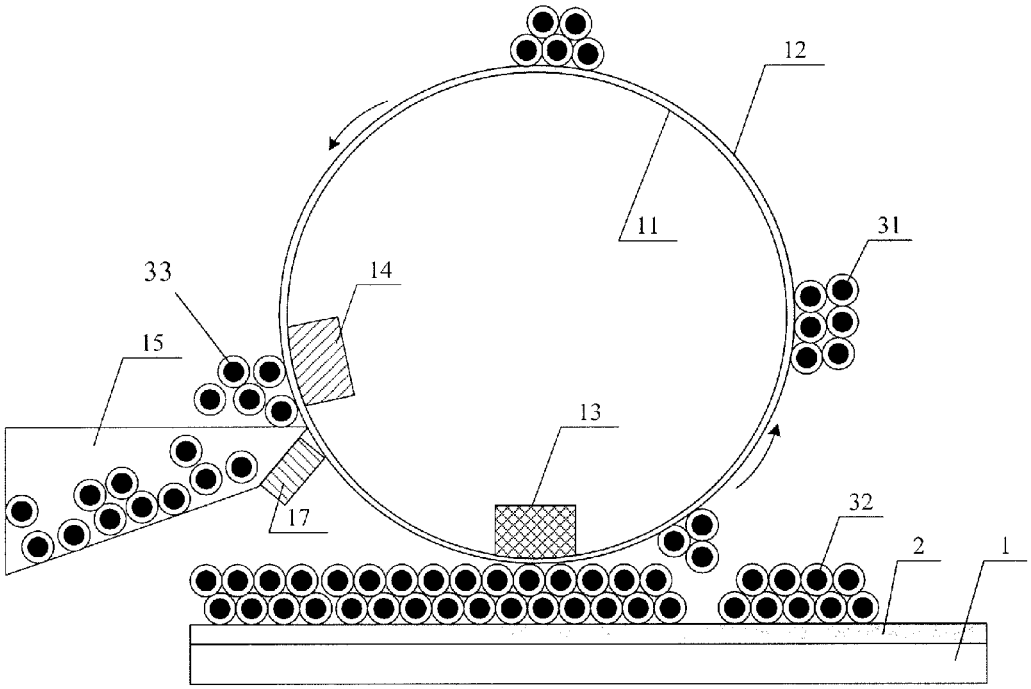
FIG. 8 is a schematic view of the mask pattern transferring device provided by a fourth embodiment of the present invention.

FIG. 8 is a schematic view of the mask pattern transferring device provided by the fourth embodiment of the present invention. As shown in FIG. 8, in addition to the components in the aforementioned embodiment, the present embodiment further comprises an spray device 17 disposed below the collecting container 15, for spraying a material, which can improve the capability of the outer resin film of the composite powders 3 to be adsorbed to the outer roller, onto the part of the outer roller 12 between the lower part of the outer edge of the collecting container 15 and the magnetization head 13, so that when the composite powders 31 magnetized by the magnetization head 13 are able to be adsorbed to the outer roller 12 under the force of magnetization, the outer resin film of the magnetized composite powders 31 may further be adsorbed to the outer roller 12 due to the action of the spray on the outer roller 12. The spray device 17 may be integral with the lower part of the outer edge of the collecting container 15, as shown in FIG. 8. An example of the spray ejected by the spray device 17 is a vapor of hexamethyldisilazane (HMDS) having adsorbing force to the outer resin film.

The method of preparing mask pattern of the embodiment of the present invention may be performed by using the mask pattern transferring device 100 provided in any of the above embodiments of the present invention to complete corresponding processes. The method of preparing mask pattern provided by the fifth embodiment of the present invention may comprise below steps:

Step 901: providing a substrate, wherein a structure layer film is formed on the substrate, and composite powders are provided on the surface of the structure layer film. An example of the composite powders comprises powders each with a core of ferromagnetic metal and an outer resin film. These composite powders are evenly distributed on the structure layer film. The ferromagnetic metal may be iron, cobalt, nickel or any alloy thereof, and the outer resin film may be Phenol formaldehyde resins (PF).

Step 902: magnetizing the composite powders on a part of the structure layer film on the substrate corresponding to the area to be without the protection of the prepared mask pattern.

The magnetization operation can be performed by controlling the magnetization head of the mask pattern transferring device. Parameters including magnetization time by the magnetization head, strength of the magnetization, and so on may be set in the magnetization operation.

Step 903: adsorbing the magnetized composite powders so that the left composite powders form a pre-mask pattern. The adsorbing operation may be performed by rotating the rotary rollers of the mask pattern transferring device to make the magnetized composite powders adsorbed onto the rotary rollers, The adsorbed magnetized composite powders may be demagnetized and then be collected. In this step, the adsorbed magnetized composite powders may be brought to the position near the demagnetization head through, for example, the rotation of the rotary roller of the mask pattern transferring device, and then be demagnetized. Then the demagnetized composite powders may be collected into the collecting container of the mask pattern transferring device.

In this method, it is also possible to firstly adsorb the demagnetized composite powders and then collect the remaining demagnetized composite powders. For example, the mask pattern transferring device may further comprise an adsorption collector, and it is possible to firstly adsorb the demagnetized composite powders by the adsorption collector, and then collect the remaining demagnetized composite powders by the collecting container.

Step 904: processing the pre-mask pattern formed on the substrate to melt the outer resin film of the left composite powders to eliminate the clearance within the pre-mask pattern, thus forming the mask pattern. The processing may be performed by for example a baking operation. Dependent on the material of the outer resin film of the composite powders 31, the processing may also be performed by a UV process or the like.

During adsorbing the magnetized composite powders by the outer roller of the mask pattern transferring device, it is possible to improve the capability of the outer roller of adsorbing the magnetized composite powders by spraying a material, which can improve the capability of the outer resin film of the composite powders to be adsorbed to the outer roller, onto the part of the outer roller between the lower part of the outer edge of the collecting container and the magnetization head by the injecting device of the mask pattern transferring device.

In the above step, the particle diameters of the composite powders are generally smaller than 500 nm, so as to facilitate evenly placing the composite powders and prevent that the clearance among the composite powders is too large. The gap between the lowermost part of the outer roller and the composite powders on the substrate may be controlled within the range of 0.2 um-5 um, so that the magnetization head can magnetize the composite powder and the composite powders can be adsorbed onto the outer roller. In the step of baking the pre-mask pattern formed on the substrate, the baking temperature may be controlled within the range of 100° C.-150° C., so as to melt the outer resin film of the composite powders.

In the method of preparing mask pattern of the present embodiment, technologies of magnetization and demagnetization are adopted to process the composite powders on the substrate to form a mask pattern, and therefore, a mask plate and a developing process and so on are not needed in the preparing of the mask pattern, and the efficiency of producing LCDs and quality of the LCDs can be improved and the cost of producing LCDs is lowered.

Figure 9:
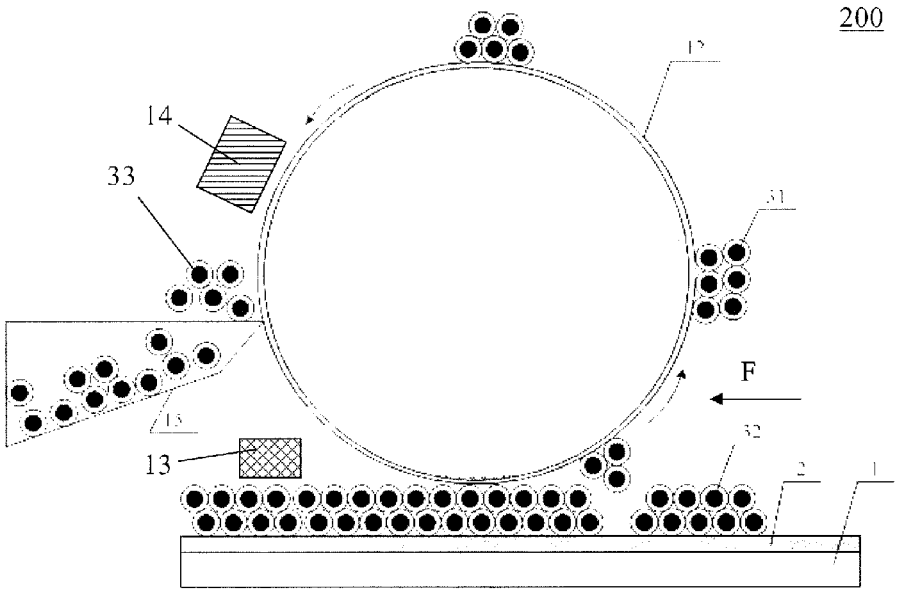
FIG. 9 is a schematic view of the mask pattern transferring device provided by a fifth embodiment of the present invention.

FIG. 9 is a schematic view of the mask pattern transferring device 200 provided by a fifth embodiment of the present invention. In this embodiment, the mask pattern transferring device 200 does not include an inner roller, and the magnetization head carrying device for amounting the magnetization head 13 is disposed in front of the rotary roller 12 formed of a non-ferromagnetic material, but is stationary relative to the rotary roller 12. The magnetization head 13 and the rotary roller 12 simultaneously move relative to the substrate 1 on which the mask pattern is to be formed, as shown by the arrow F. Further, the demagnetization head 14 is also disposed in front of the rotary roller 12, and is stationary relative to the rotary roller 12, but is located at the downstream of the magnetization head 13. Therefore, the composite powders 31 on the structure layer film 2 on the surface of the substrate is firstly magnetized by the magnetization head 13, and then adsorbed by the rotary roller 12. Then, the adsorbed composite powders 31 are demagnetized by the demagnetization head 14, and then collected by the collecting container 15.

In the device 200 of this embodiment, as shown in FIG. 6, the adsorption collector 16 may be located at the downstream of the demagnetization head 14 and be disposed toward the magnetization head 14, so as to adsorb the composite powders demagnetized by the demagnetization head 14. Or, as shown in FIG. 8, an spray device 17 is disposed below the collecting container 15, for spraying a material, which may improve the capability of the outer resin film of the composite powders 3 to be adsorbed to the outer roller 12, onto the part of the outer roller 12 between the lower outer edge of the collecting container 15 and the magnetization head 13.

The method of preparing mask pattern of the present embodiment may be performed by the mask pattern transferring device 200 provided in the above embodiment to complete corresponding processes, the details of which are omitted in order to be clear.

Finally, what should be noted is that the above embodiments are just used to explain the technical solutions of the present invention, rather than used to make limitation to them; while detailed description has been made with reference to the above embodiments, it will be understood by those skilled in the art that various changes may be made and equivalents may be substituted for elements thereof; said changes and equivalents do not make the essence of the corresponding technical solutions depart from the spirit and scope of the technical solutions of the various embodiments of the present invention.

What is claimed is:

1. A mask pattern transferring device, comprising:

a magnetization head disposed on a magnetization head carrying device, for magnetizing composite powder, each particle of the composite powder comprising a core of ferromagnetic metal and an outer resin film;

a rotary roller formed of a non-ferromagnetic material, for adsorbing the composite powder magnetized by the magnetization head;

a demagnetization head disposed downstream the magnetization head in a rotating direction of the rotary roller, for demagnetizing the magnetized composite powder adsorbed by the rotary roller; and a collecting container, an outer edge of which is tangent with the rotary roller, and which is disposed downstream the magnetization head along a periphery of the rotary roller to collect the demagnetized composite powder, wherein the mask pattern transferring device further comprises a spray device disposed below the collecting container, for spraying a material, which improves the capability of the magnetized composite powder to be adsorbed onto the rotary roller, onto a part of the rotary roller between a lower outer edge of the collecting container and the magnetization head.

2. The mask pattern transferring device according to claim 1, wherein the magnetization head carrying device is an inner roller and the inner roller is disposed within the rotary roller, and is stationary relative to an axle of the inner roller.

3. The mask pattern transferring device according to claim 2, wherein the magnetization head is disposed downstream the magnetization head in the rotating direction of the rotary roller, and is disposed on the inner roller, and is stationary relative to the axle of the inner roller.

4. The mask pattern transferring device according to claim 3, wherein the demagnetization head is disposed lower than the radial center of the inner roller.

5. The mask pattern transferring device according to claim 3, further comprising an adsorption collector disposed on the outer side of the rotary roller, wherein a collecting mouth of the adsorption collector faces the demagnetization head in a radial direction of the rotary roller, for collecting the composite powder demagnetized by the demagnetization head.

6. The mask pattern transferring device according to claim 2, wherein the magnetization head is disposed on a lowermost part of the inner roller.

7. The mask pattern transferring device according to claim 1, further comprising an adsorption collector disposed on the outer side of the rotary roller, wherein a collecting mouth of the adsorption collector faces the demagnetization head, for collecting the composite powder demagnetized by the demagnetization head.

8. The mask pattern transferring device according to claim 1, wherein the spray device is integrated with the lower outer edge of the collecting container.

9. The mask pattern transferring device according to claim 1, wherein the magnetization head carrying device is disposed in front of the rotary roller.

10. A method of preparing a mask, comprising:

providing a substrate, wherein a structure layer film is formed on the substrate, a layer of composite powder is formed on a surface of the structure layer film, and each particle of the composite powder includes a core of ferromagnetic metal and an outer resin film;

magnetizing composite powder on a part of the structure layer film on the substrate corresponding to an area to be without protection of the mask;

adsorbing the magnetized composite powder with a rotary roller formed of a non-ferromagnetic material, so as to form a pre-mask pattern with composite powder remaining on the substrate;

processing the pre-mask pattern formed on the substrate, so that the outer resin films of the particles of the composite powder remaining on the substrate is melted to eliminate clearance within the pre-mask pattern, thus forming the mask; and spraying a material onto the rotary roller to improve the capability of the magnetized composite powder to be adsorbed onto the rotary roller.

11. The method of preparing a mask according to claim 10, wherein after adsorbing the magnetized composite powder, demagnetizing the magnetized composite powder and collecting the demagnetized composite powder.

12. The method of preparing a mask according to claim 11, wherein after demagnetizing, collecting the demagnetized composite powder with a collecting container.

13. The method of preparing a mask according to claim 11, wherein a demagnetization head is used to demagnetize the magnetized composite powder.

14. The method of preparing a mask according to claim 10, wherein the sprayed material is vapor of hexamethyldisilazane.

15. The method of preparing a mask according to claim 10, wherein the particle diameter of each particle of the composite powder is smaller than 500 nm.

16. The method of preparing a mask according to claim 10, wherein a gap between the lowermost part of the rotary roller and the composite powder on the substrate is within a range of 0.2 um-5 um.

17. The method of preparing a mask according to claim 10, wherein said processing is a baking process, and a baking temperature is within a range of 100° C.-150° C.

* * * * *